United States Patent [19]

Focke et al.

[11] Patent Number: 4,961,496

[45] Date of Patent: Oct. 9, 1990

[54] CIGARETTE PACK, ESPECIALLY HINGE-LID BOX

[75] Inventors: Heinz Focke; Kurt Liedtke, both of Verden, Fed. Rep. of Germany

[73] Assignee: Focke & Co. (GmbH & Co.), Verden, Fed. Rep. of Germany

[21] Appl. No.: 440,171

[22] Filed: Nov. 22, 1989

[30] Foreign Application Priority Data

Nov. 24, 1988 [DE] Fed. Rep. of Germany ..... 3839553

[51] Int. Cl.[5] ..... B65D 25/06; B65D 85/10

[52] U.S. Cl. ..... 206/246; 206/258; 229/87.13

[58] Field of Search ..... 206/256, 257, 258, 246, 206/271, 273, 264, 614; 229/120.09, 87 C

[56] References Cited

U.S. PATENT DOCUMENTS

| | | | |
|---|---|---|---|
| 2,811,247 | 10/1957 | Stevenson | 206/614 X |
| 2,958,417 | 11/1960 | Adams | 206/246 |
| 3,018,878 | 1/1962 | Watkins | 206/246 |
| 3,028,950 | 4/1962 | Content | 206/246 |
| 3,079,064 | 2/1963 | Ringler | 229/87 C |
| 3,096,878 | 7/1963 | Whitley et al. | 206/264 X |
| 4,207,976 | 6/1980 | Herman | 206/256 X |
| 4,375,260 | 3/1983 | Focke et al. | 206/273 X |
| 4,664,310 | 5/1987 | Schmidt | 229/87 C |

FOREIGN PATENT DOCUMENTS

| | | | |
|---|---|---|---|
| 1218067 | 1/1971 | United Kingdom | 229/87 C |

*Primary Examiner*—Paul T. Sewell
*Assistant Examiner*—Jacob K. Ackun, Jr.
*Attorney, Agent, or Firm*—Sughrue, Mion, Zinn, Macpeak & Seas

[57] ABSTRACT

Known conventional cigarette packs, especially those with a hinge-lid box (10), an inner blank (29) made of tin-foil and possibly an outer wrapping made of plastics foil, are not suitable for disposing of smoked cigarettes (waste-cigarettes 48). It is felt to be undesirable that smoked cigarettes be thrown away individually. This is especially true for "artificial cigarettes" which have recently appeared on the market. In order to achieve an improved waste-disposal, the present cigarette pack, especially as regards its embodiment with a hinge-lid box (10), is provided with a waste compartment (47) for holding waste-cigarettes (48). Park of the inner blank (28), namely its rear-wall (30), forms a partition between the waste compartment (47) and a cigarette compartment (46). Smoked cigarettes are reinserted into the pack through an insert-opening (54).

8 Claims, 6 Drawing Sheets

CIGARETTE PACK, ESPECIALLY HINGE-LID BOX

BACKGROUND OF THE INVENTION

The invention relates to a cigarette pack with box, especially a hinge-lid box, for a group of cigarettes (cigarette-group).

Cigarette packs are marketed in very different embodiments. The conventional structure of a cigarette pack is as follows: An inner blank, especially a tin-foil blank accomodates the cigarette-group in the form of a block. The box of the cigarette pack can be constructed in different ways, for example as a soft-box or a hinge-lid box. Normally the box is enwrapped by an outer wrapping made of plastics foil.

The invention is concerned with improving such cigarette packs, especially those where the box is designed as a hinge-lid box. The new features of the construction concern a previously not mentioned or solved problem of waste disposal. Smoked cigarettes are usually thrown away, often in public streets and places. Especially as regards new type (artificial) cigarettes, which practically keep their full original length after being smoked, this sort of waste-spreading is highly undesirable. What is more, these types of cigarettes contain non-decaying components.

SUMMARY OF THE INVENTION

The invention wants to counteract this type of spreading waste. It is based on the object to design packs so that they additionally serve for holding smoked cigarettes.

In order to achieve this object, the cigarette pack according to the invention is characterized in that a deformable partition is arranged inside and connected to the box (hinge-lid box). This partition separates a cigarette-compartment from a waste-compartment (for smoked cigarettes).

The partition according to the invention is constructed and positioned in such a way that the cigarette-compartment for holding fresh and unused cigarettes practically fills the whole inside of the cigarette pack before it is put into use. After one cigarette has been removed and smoked, it is reinserted in the cigarette pack, namely in the box, and to be specific, into the waste-compartment designated for this function. Continuing consumption of cigarettes and reinsertion of smoked cigarettes deform the partition as regards size and shape. Finally, when the cigarette pack has been used up, the waste-compartment fills the whole inside of the box.

According to a further characteristic of the invention, the partition extends transversely in the box from one side-wall to the other, and is connected at least to one of the side-walls, especially by adhesion.

According to a further important characteristic of the invention, the partition is formed by the inner wrapping of the cigarette group, that means particularly by the tin-foil blank, which has been designed for this purpose in a special way. The blank is joined or glued to the inside of the box in such a way that one rear part of the inner blank can act as the partition.

Smoked cigarettes can be reinserted through the given, "natural" opening. According to a further characteristic of the invention, however, the box is provided with a separate insert-opening for smoked cigarettes. Preferably, this opening sits in the rear-wall of the box by the edge. The cigarettes being inserted into this insert-opening come straight into the waste-compartment.

Another special feature of the invention is that the outer plastics foil wrapping has two transverse tearing-strips, being spaced apart, so that when the cigarette pack is put into use, the outer wrapping is removed save for a roughly centric encircling strip, which makes it possible to introduce smoked cigarettes through the insert-opening.

Other characteristics of the invention concern the design of the inner and outer wrapping and of the box.

Further details of a preferred embodiment of the invention, namely a cigarette pack with hinge-lid box, are described below with reference to the drawings which show:

DETAILED DESCRIPTION OF A PREFERRED EMBODIMENT

The drawings show details of a preferred embodiment of a cigarette pack, namely a pack with a hinge-lid box 10. This box is designed conventionally as regards its basic structure, that is with a main part 11 for holding a cigarette-group 12 and a lid 13 hinged to main part 11.

Figure 1:
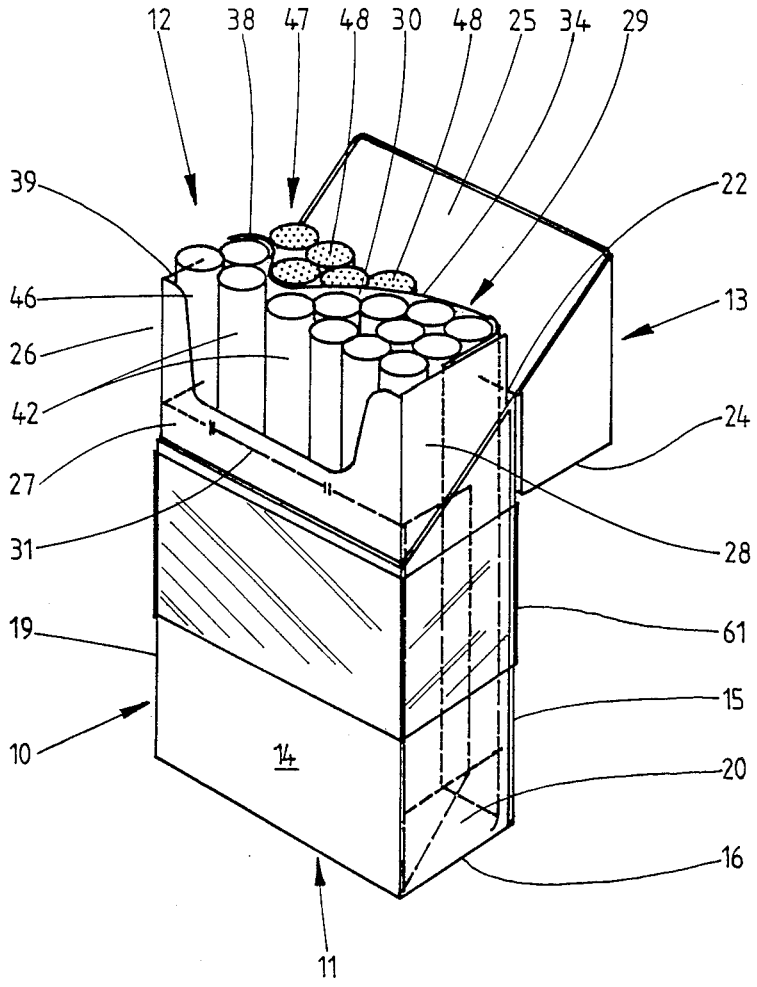
FIG. 1 a perspective view of a cigarette pack with opened hinge-lid box.
Figure 7:
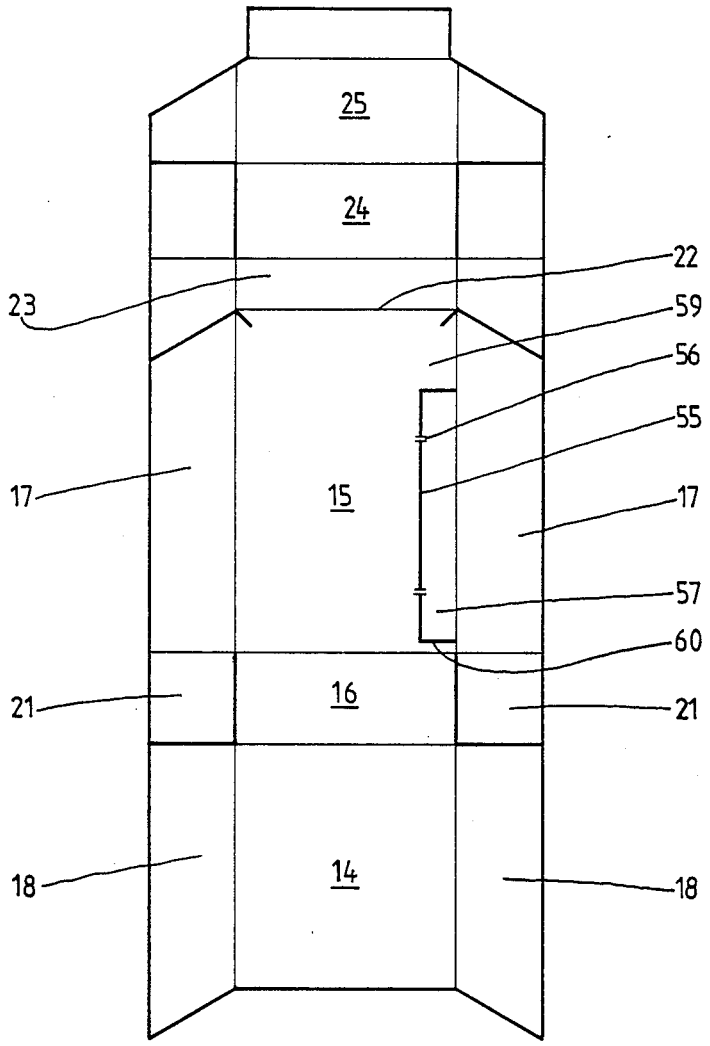
Figure 9:
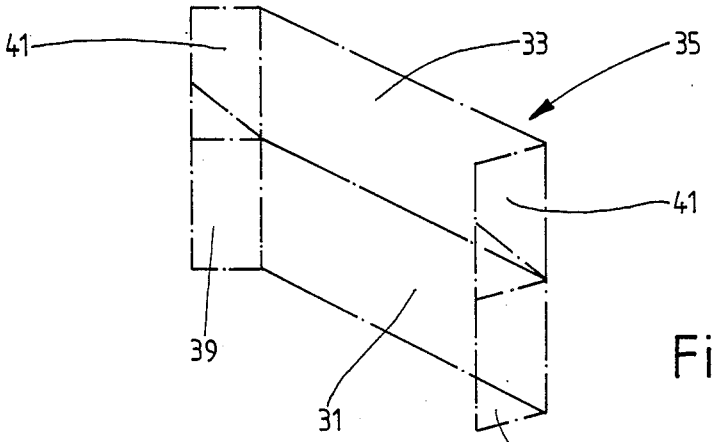

Hinge-lid box 10 is formed out of one blank, an embodiment of which is shown in FIG. 7. Folding lines define the sections forming a box front-wall 14, a box rear-wall 15 and a box bottom-wall 16, extending inbetween the two. Box front-wall 14 and box rear-wall 15 adjoin inner box side-tabs 17 and outer side-tabs 18 which form (double-layered) box side-walls 19 and 20 (FIG. 1). Joined to the inner side-tabs 17 are bottom corner-tabs 21, which rest against the inside of box bottom-wall 16 in the completed hinge-lid box 10.

Blank sections for forming the lid 13 are connected to the box rear-wall 15 of main part 11 via a hinge-line 22. This hinge-line 22 delimits the box rear-wall 15 from a lid rear-wall 23. To the latter adjoins a lid top-wall 24 and a lid front-wall 25.

Within the hinge-lid box 10, namely in main part 11, which is folded together out of the blank according to FIG. 7, is a collar 26 which reaches out of the top of the main part. This collar 26 rests with its front-wall 27 against the inside of the front-wall 14 of main part 11. Collar side-walls 28 are on the inside connected to box side-walls 19, 20.

Figure 6:
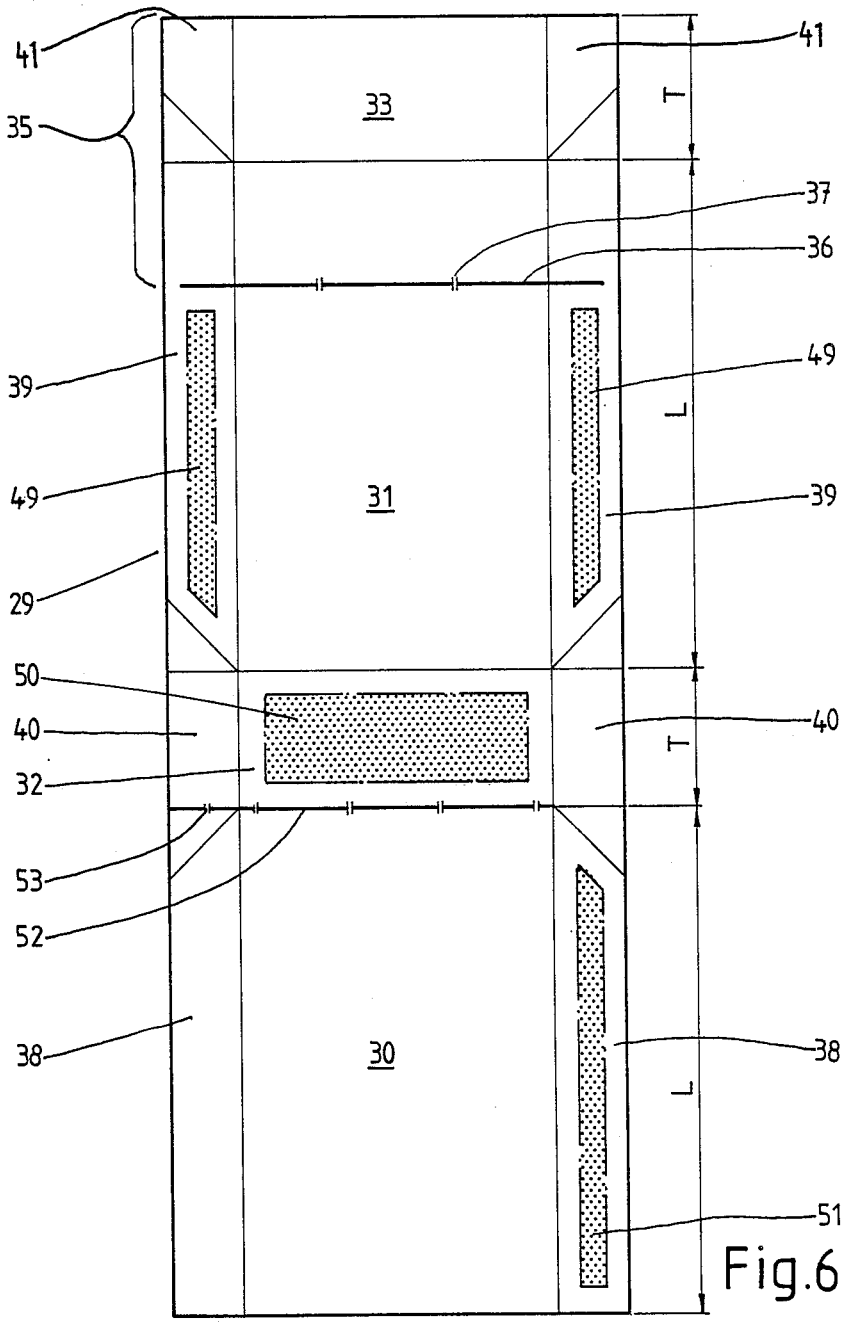

The cigarette-group 12 is wrapped in an inner blank 29, preferably a tin-foil blank. Inner blank 29 is formed in a special way (FIG. 6). Within the rectangular inner blank 29 are defined sections for forming a rear-wall 30, a front-wall 31 and an intermediately formed bottom-wall 32. The box rear-wall 15 of main part 11 in the completed cigarette pack extends over the whole length of cigarette-group 12, so that length L of rear-wall 30 approximately corresponds to the length of a cigarette.

Figure 8:
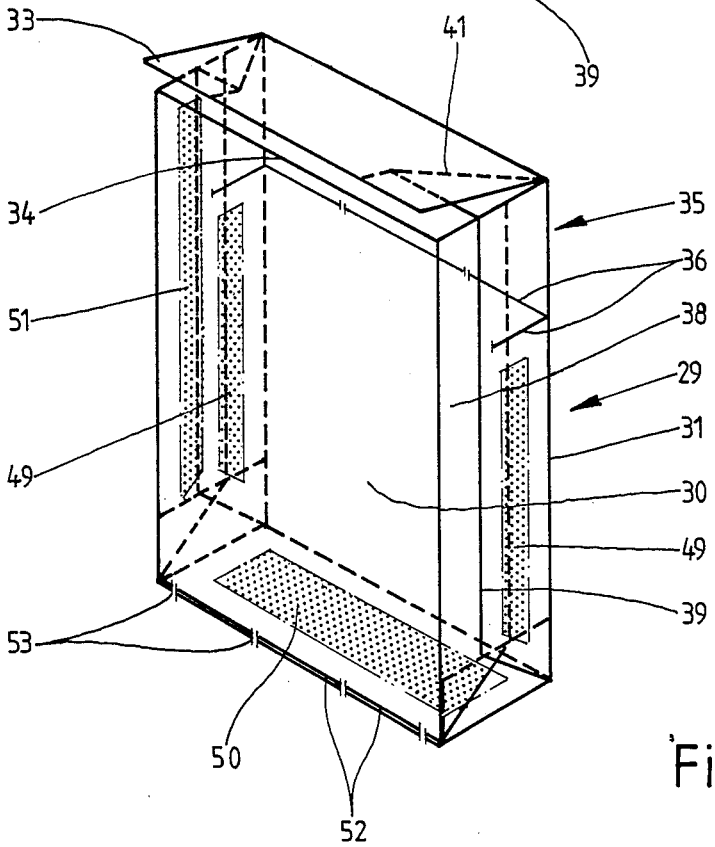

Front-wall 31 has approximately the same length L. A cover-wall 33 adjoins to the upper edge of front-wall 31. This cover-wall 31 measures in longitudinal direction of the blank the same as depth D of hinge-lid box 10, that is to say of the inside of box 10. With the completed, unused pack, cover-wall 33 is—starting out from front-wall 31—folded against the upper end face of cigarette-group 12 (FIG. 8). Cover-wall 33 roughly extends to one free top edge 34 of rear-wall 30.

An upper section of front-wall 31 forms flap 35, which can be torn off the remaining, lower part. Flap 35 consists of an upper part of front-wall 31 and the cover-wall 33. In order to guarantee that flap 35 can be torn off when the cigarette pack is put into use, the flap 35 is delimited from the rest of front-wall 31 by a transverse punch, consisting of punch-cuts 36 and a few remnant connections 37.

Rear-wall 30 and front-wall 31 of inner blank 29 are equipped on both sides with side-tabs 38, 39. These have a specific width, so that when inner blank 29 is folded together (FIG. 8), they partially overlap each other.

Bottom side-tabs 40 are on the one hand connected to bottom-wall 32 and on the other to adjoining side-tabs 38, 39. They are folded into an upright position and abut the inside of the (folded) side-tabs 38, 39.

Figure 2:
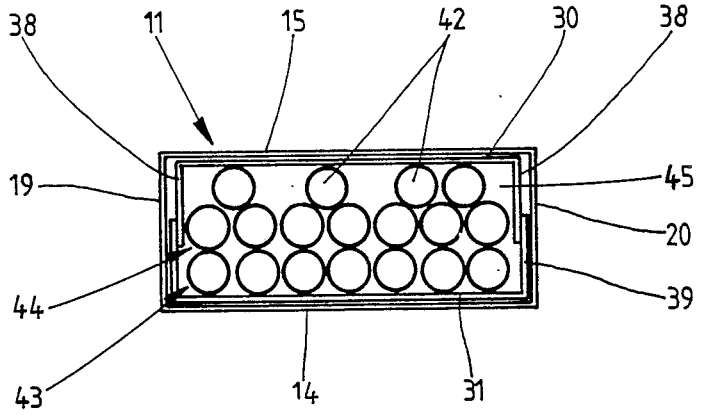
FIG. 2 a horizontal section of a cigarette pack before put into use.
Figure 3:
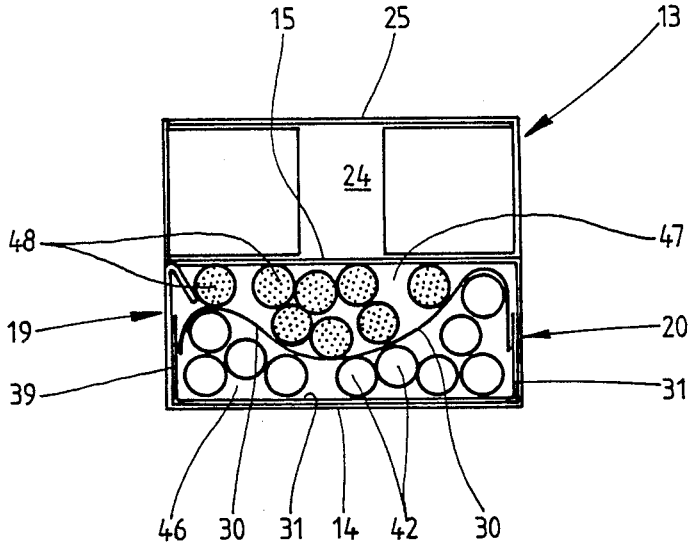
FIG. 3 a plan-view of a cigarette pack with smoked cigarettes.
Figure 4:
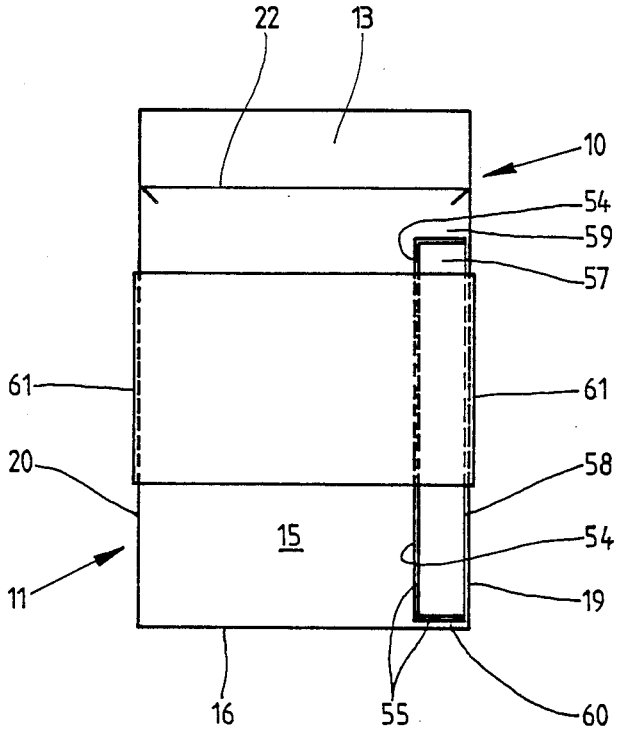
FIG. 4 the rear view of a cigarette pack, FIG. 5 a horizontal section of a detail of a cigarette pack in the area of an insert-opening, on a much enlarged scale, FIG. 6 a spread-out blank for an inner wrapping, FIG. 7 a spread-out blank for the hinge-lid box, FIG. 8 a perspective view of a folded inner wrapping, FIG. 9 a perspective view of a flap, being part of the inner wrapping.

Side cover-wall-tabs 41 are also arranged in the area of cover-wall 33 in line with side-tabs 39. When cover-wall 39 is folded against the upper end face of cigarette-group 12, side cover-wall-tabs 41 are folded against the inside of cover-wall 39, in the process of which they become trapeziformed tabs. The so constructed cigarette pack is meant for holding a cigarette-group 12 with a multitude of specifically arranged cigarettes 42. The shown embodiment (FIG. 2) has a cigarette-group 12 with altogether eighteen cigarettes 42. These are arranged in rows, that is in two rows 43 and 44 with seven cigarettes 42 each and one row 45 with 4 cigarettes 42. Some of these are spaced out, in any case they are staggered (saddle position) relative to cigarettes of middle row 44. It follows that the inside of the cigarette-pack is not completley filled out by cigarette-group 12.

The inside of the cigarette-pack or rather of the hinge-lid box 10 is designed so that two compartments are formed which alter in size and shape. On the one hand there is a cigarette compartment 46 and on the other a waste compartment 47. The former serves for holding fresh, unsmoked cigarettes, the latter for holding smoked, waste-cigarettes 48. Compartments 46, 47 alter their shape and size during the process of cigarettes 42 being used and waste-cigarettes 48 being reinserted in the cigarette pack. With the shown embodiment, waste compartment 47 is on the side facing box rear-wall 15, so that fresh cigarettes 42 can be taken out from the free front of hinge-lid box 10.

The two compartments 46, 47 are seperated by a partition, which in the present embodiment extends through the inside of the hinge-lid box, that is to say the inside of main part 11, from one box side-wall 19 to the other box side-wall 20. When the cigarette pack is put into use, waste compartment 47 is very small. The whole inside of the cigarette pack is filled by cigarette compartment 46. With progressing use of cigarettes 42, waste compartment 47 gets bigger and cigarette compartment 42 correspondingly smaller, until finally waste-compartment 47 with cigarette-group 12 consisting of a respective amount of waste-cigarettes 48 fills the entire inside of the cigarette pack.

The partition can be formed between the two compartments 46 and 47 by a separate deformable blank inside main part 11 of hinge-lid box 10. With the shown embodiment, the partition is formed by the rear-wall 30 of inner blank 29. For this reason, rear-wall 30 extends over the entire height of the inside of the hinge-lid box and therefore over the whole length of cigarettes 42.

Certain provisions are made in order to ensure the effectiveness of rear-wall 30 as a partition between compartments 46 and 47. Front-wall 31 is anchored in the hinge-lid box 10, that is in main part 11 via side-tabs 39. For this reason, these are anchored with an adhesive strip 49 to the inside of hinge-lid box 10, namely to box side-walls 19 and 20. The adhesive strip 49 only extends in the region beyond flap 35, so that this flap can be pulled off without obstructions when the cigarette pack is put into use.

Furthermore, bottom-wall 32 is anchored to the inside of box bottom-wall 16 with a rather large adhesive surface 50.

Also of importance is finally the design and anchoring of rear-wall 30. On the one side, rear-wall 30 is connected with its side-tabs 38 to the inside of one box side-wall 20 with the aid of an adhesive strip 51. Side-tab 38, which is facing box side-wall 19 remains free without any connection. Therefore this part of rear-wall 30—including adjoining side-tabs—can be moved freely in transverse direction in main part 11 of hinge-lid pack 10, thus changing the relative position of the partition (rear-wall 30).

In order to further improve the movability of rear-wall 30 in its function as a partition, it is partially separable of the rest of inner blank 29. For this purpose, rear-wall 30 and adjoining free side-tab 38 are anchored to bottom-wall 32 and bottom side-tab 40 via perforations or punch-cuts 52 with remnant connections 53. When waste compartment 47 is put into use, the connection is broken, so that rear-wall 30 including side-tab 38 are freely movable in transverse direction in the bottom section as well. Also, it is clear that the combined width of rear-wall 30 and its adjoining free side-tab 38 is greater than the width of the box 10.

Figure 5:
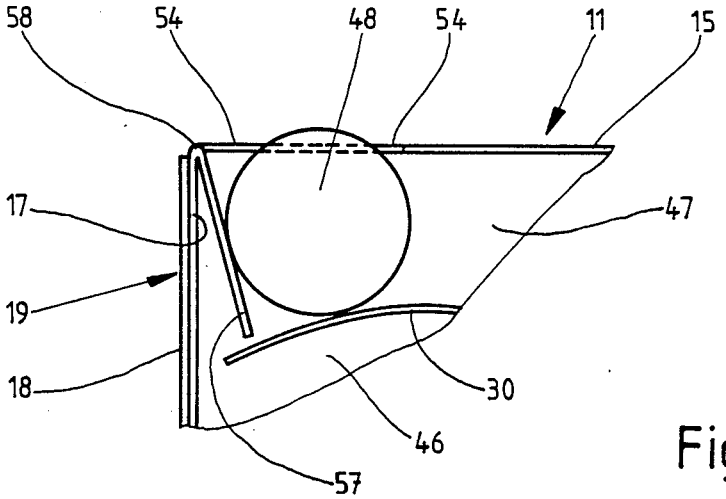

The smoked cigarettes—waste-cigarettes 48—can be inserted into the waste compartment 47 through the main opening of hinge-lid pack 10 with opened lid 13. It is more favourable though, to provide a separate insert-opening for waste-cigarettes 48. In the present embodiment this has been placed in the area of box rear-wall 15, neighbouring one of its edges. Insert-opening 54 neighbours box side-wall 19, therefore sitting on the side on which rear-wall 30 of inner blank 29 is freely movable in transverse direction. Insert-opening 54 is formed by a U-punch 55 with remnant connections 56 in the blank (FIG. 7) of hinge-lid box 10. Thus, a rectangular hinged flap 57 is formed, which is pushed in (FIG. 5) for inserting a waste-cigarette 48 into the cigarette pack. After the insertion of a waste-cigarette 48 into waste-compartment 47, the hinged flap 57 moves back to its original position, due to the restoring forces of the material, to act as a closure for the insert-opening 54. The hinge of hinged flap 57 is formed by a rear upright pack edge 58.

The dimensions of hinged flap 57 and therewith of insert-opening 54 roughly correspond to the diameter of a waste-cigarette 48 widthwise but are shorter than the cigarettes longitudinally. This means that waste-cigarettes 48 can be pushed into hinge-lid box 10 with a longitudinally directed movement. The shorter length of insert-opening 54 leaves above and below the stops 59, 60 which hold waste-cigarettes 48 in the waste compartment 47.

The hinge-lid box 10 can be provided with a usual outer wrapping made of a thin plastics or viscose foil. In the present embodiment, this outer wrapping has two transverse tearing-strips (not shown) which are spaced apart. These conventional and known tearing-strips facilitate tearing the outer wrapping so it can be pulled off. With providing an upper and a lower tearing-strip, an upper and a lower cap-like part of the outer wrapping can be pulled off hinge-lid box 10, leaving an encircling-strip 61, which encircles hinge-lid box 10 in roughly centric position. The strip has been arranged so that insertion of waste-cigarettes 48 through the lower part of insert-opening 54 is possible.

The cigarette pack constructed in the described way is used as follows: After removing the upper and lower part of the outer wrapping and after opening lid 13, the flap 35 is pulled out, thus uncovering cigarettes 42 on the top end, ready to be taken out (FIG. 1). After a first cigarette 42 has been removed, the original formation of cigarette-group 12 (FIG. 2) collapses, leaving a certain free space within hinge-lid box 10, which enables the smoked cigarettes to be reinserted as waste-cigarettes 48 through the insert-opening 45. Inserting the first waste-cigarette 48 severs rear-wall 30 and a side-tab 38 from a bottom-wall 32 and bottom side-tab 40, so that rear-wall 30 can be partially moved into the inside of the box, thus taking over its function as a partition. By and by cigarettes can now be removed, smoked and reinserted as waste-cigarettes, until the pack is filled with these waste-cigarettes and can be disposed of as a whole.

The inner blank 29, that is to say the partition for seperating compartments 46 and 47 can also be made of flame-resistant material, such as aluminium foil or another metal foil without paper layer. This provides for the case of inserting smoked cigarettes into the box, which have not been completely extinguished.

What is claimed is:

1. A cigarette pack with a box, especially a hinge-lid box for a cigarette-group, comprising a deformable partition arranged in the box (10) and connected to the latter, said partition separating a cigarette compartment (46) from a waste compartment (47) for waste-cigarettes (48); wherein the partition comprises a rear-wall (30) of an inner blank (29) of a cigarette-group (12); and wherein the rear wall (30) of the inner blank (29) extends from a bottom-wall (32) approximately up to the edge of the cigarette-group (12) without having a connection with an upper cover-wall (33) of the inner blank.

2. Cigarette pack according to claim 1, wherein the partition is connected to a box side-wall (20) and to a box bottom-wall (16), by adhesion.

3. Cigarette pack according to claim 1, wherein a front-wall (31) of the inner blank (29) forms in a top section a flap (35), including a removable cover-wall (33), in such a way that, after the flap (35) is removed, the cigarette-group is uncovered in the region of an upper front part and completely uncovered in the region of an upper end face.

4. Cigarette pack according to claim 3 wherein the front-wall (31) of the inner blank (29) is fixed in the box (10), by front-wall side-tabs (39) stuck to the inside of box side-walls (19, 20) with the aid of adhesive strips (49).

5. Cigarette pack according to claim 1, comprising an outer wrapping, made of plastics foil or the like, and forming an encircling-strip (61) in a central region of the box (10).

6. Cigarette pack according to claim 1 or 2, wherein the width of the partition (30), (38)—measured in the plane of a pack front-wall (14) and pack rear-wall (15)—is greater than that of the box (10), in such a way that by appropriate deformation of the partition (30), the size and shape of the two compartments (46, 47) can be altered.

7. A cigarette pack with a box, especially a hinge-lid box for a cigarette-group, comprising a deformable partition arranged in the box (10) and connected to the latter, said partition separating a cigarette compartment (46) from a waste compartment (47) for waste-cigarettes (48); wherein the partition is connected to a box side-wall (20) and to a box bottom-wall (16), by adhesion; wherein the partition is formed by a rear-wall (30) of an inner blank (29) of a cigarette-group (12); wherein the blank rear-wall (30) has a first adjoining side-tab (38), connected to an inside of one box side-wall (20) by an adhesive strip (51), and an oppositely situated secon adjoining side-tab (38) with no connection to the box (10); and wherein the rear-wall (30) and the adjoining, unconnected second side-tab (38) is severable from the rest of the inner blank via a severable connection between the blank rear-wall (30) and a blank bottom-wall (32).

8. A cigarette pack with a box, especially a hinge-lid box for a cigarette-group, comprising a deformable partition (30) arranged in the box (10) and connected to the latter, said partition (30) separating a cigarettes (48); wherein the box (10) has a separate insert opening (54) for inserting waste-cigarettes (48) into the waste-compartment (47); and wherein the insert-opening (54) is formed by a U-punch (55) in such a way that a hinged-flap (57), pivoting on a pack edge (58), is formed and acts as a closure of the insert-opening (54) after a waste-cigarette is inserted therein, and wherein the insert-opening (54) is formed in the region of a box rear-wall (15), has a width corresponding approximately to the diameter of a waste cigarette (48), and has a length shorter than unsmoked cigarettes.

* * * * *